US011087682B2

(12) United States Patent
Zhang

(10) Patent No.: US 11,087,682 B2
(45) Date of Patent: Aug. 10, 2021

(54) METHOD, APPARATUS, AND SYSTEM OF COMPENSATING AN OLED IN A DISPLAY PANEL FOR EFFICIENCY DECAY

(71) Applicant: Shenzhen China Star Optoelectronics Semiconductor Display Technology Co., Ltd., Guangdong (CN)

(72) Inventor: Liuqi Zhang, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/757,812

(22) PCT Filed: Feb. 18, 2020

(86) PCT No.: PCT/CN2020/075664
§ 371 (c)(1),
(2) Date: Apr. 21, 2020

(65) Prior Publication Data

US 2021/0201777 A1 Jul. 1, 2021

(30) Foreign Application Priority Data

Dec. 27, 2019 (CN) ..... 201911372268.7

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2310/0264* (2013.01);
(Continued)

(58) Field of Classification Search
CPC .. G09G 3/3225; G09G 3/3233; G09G 3/2007; G09G 2310/0264; G09G 2320/043; G09G 2320/045; G09G 2320/0233
See application file for complete search history.

(56) References Cited

U.S. PATENT DOCUMENTS

2007/0008251 A1 1/2007 Kohno
2009/0195483 A1 8/2009 Naugler, Jr. et al.
(Continued)

FOREIGN PATENT DOCUMENTS

CN 102855842 A 1/2013
CN 103871358 A 6/2014
(Continued)

*Primary Examiner* — Kenneth Bukowski
(74) *Attorney, Agent, or Firm* — Mark M. Friedman

(57) ABSTRACT

A method, an apparatus, and a system of compensating an organic light emitting diode (OLED) in a display panel for efficiency decay are disclosed. The method includes acquiring an IV curve of the OLED device according to a drain voltage with grayscales applied to a driven thin-film transistor (TFT) and an output current; comparing the IV curve with an IV curve database model, and determining a target curve and a first match curve; determining a second match curve according to a measuring moment; acquiring a target voltage corresponding to a target luminance; acquiring a target current corresponding to the target voltage; and acquiring, based on a characteristic curve of the driven TFT, a compensated gate voltage through the target voltage, the target current, and the drain voltage. The OLED device can be compensated for efficiency decay. Display effects are improved, causing the display panel to display uniformly.

12 Claims, 12 Drawing Sheets

(52) U.S. Cl.
CPC ..... *G09G 2320/0233* (2013.01); *G09G 2320/045* (2013.01)

(56) References Cited

U.S. PATENT DOCUMENTS

| | | | | |
|---|---|---|---|---|
| 2013/0037827 | A1* | 2/2013 | Levermore | H01L 27/3204 257/88 |
| 2014/0063080 | A1 | 3/2014 | Wu et al. | |
| 2014/0160142 | A1 | 6/2014 | Lee et al. | |
| 2014/0320475 | A1* | 10/2014 | Shin | G09G 3/3275 345/212 |
| 2015/0054722 | A1* | 2/2015 | Kanda | G09G 3/3233 345/77 |
| 2016/0379551 | A1 | 12/2016 | Zhuang et al. | |
| 2017/0098407 | A1* | 4/2017 | Jeong | G09G 3/2051 |
| 2017/0132979 | A1* | 5/2017 | Oh | G09G 3/3233 |
| 2018/0211603 | A1 | 7/2018 | Lu et al. | |
| 2020/0058249 | A1* | 2/2020 | Ok | G09G 3/3208 |
| 2020/0388219 | A1 | 12/2020 | Meng et al. | |

FOREIGN PATENT DOCUMENTS

| | | | |
|---|---|---|---|
| CN | 105096824 | A | 11/2015 |
| CN | 107909965 | A | 4/2018 |
| WO | 2016209347 | A1 | 12/2016 |

* cited by examiner

METHOD, APPARATUS, AND SYSTEM OF COMPENSATING AN OLED IN A DISPLAY PANEL FOR EFFICIENCY DECAY

BACKGROUND OF DISCLOSURE

1. Field of Disclosure

The present disclosure relates to the field of display technology, and more particularly, to a method, an apparatus, and a system of compensating an organic light emitting diode (OLED) in a display panel for efficiency decay.

2. Description of Related Art

Organic light emitting diodes (OLEDs) are used in an auto-luminescence display technology and have the advantages of wide viewing angle, high contrast, low power consumption, being colourful, and so on. Due to the advantages, active matrix organic light emitting diodes (AMOLEDs) have an increasing ratio in the display technology. However, with the prolonged using time of display panels, there is a significant decrease in illuminating efficiency of OLED devices. The OLED devices fail eventually due to inconsistent display and other problems.

SUMMARY

A technical problem existed in conventional technologies is that in the course of using conventional display panels, illuminating efficiency decay occurs in organic light emitting diode (OLED) devices, resulting in an inconsistent display.

Based on the problem that in the course of using conventional display panels, illuminating efficiency decay occurs in OLED devices, resulting in an inconsistent display, a technical solution to provide a method, a device, and a system of compensating an OLED device in a display panel for efficiency decay is necessary.

In order to realize the above object, an embodiment of the present disclosure provides a method of compensating an organic light emitting diode (OLED) device in a display panel for efficiency decay, the method including the following steps:

acquiring an IV curve of the OLED device according to a drain voltage with a preset number of grayscales applied to a driven thin-film transistor (TFT) and an output current corresponding to the drain voltage;

comparing the IV curve with an IV curve database model, and determining a target curve and a first match curve of the OLED device, wherein the IV curve database model includes a plurality of curves of current versus voltage measured at different moments;

determining a second match curve corresponding to a measuring moment in an LV curve database model, according to a measuring moment corresponding to the first match curve, wherein the LV curve database model includes a plurality of curves of luminance versus voltage measured at different moments;

acquiring, based on the second match curve, a target voltage corresponding to a target luminance; acquiring, based on the target curve, a target current corresponding to the target voltage; and acquiring, based on a characteristic curve of the driven TFT, a compensated gate voltage of the driven TFT through the target voltage, the target current, and the drain voltage.

In another aspect, an embodiment of the present disclosure further provides an apparatus configured to compensate an organic light emitting diode (OLED) device in a display panel for efficiency decay, the apparatus including:

an IV-curve establishing unit configured to acquire an IV curve of the OLED device according to a drain voltage with a preset number of grayscales applied to a driven thin-film transistor (TFT) and an output current corresponding to the drain voltage;

a first IV-curve match unit configured to compare the IV curve with an IV curve database model and to determine a target curve and a first match curve of the OLED device, wherein the IV curve database model includes a plurality of curves of current versus voltage measured at different moments;

a second IV-curve match unit configured to determine a second match curve corresponding to a measuring moment in an LV curve database model, according to a measuring moment corresponding to the first match curve, wherein the LV curve database model includes a plurality of curves of luminance versus voltage measured at different moments;

a target-voltage-current acquiring unit configured to acquire, based on the second match curve, a target voltage corresponding to a target luminance and to acquire, based on the target curve, a target current corresponding to the target voltage; and a gate-voltage compensating unit configured to acquire, based on a characteristic curve of the driven TFT, a compensated gate voltage of the driven TFT through the target voltage, the target current, and the drain voltage.

In another aspect, an embodiment of the present disclosure further provides a system configured to compensate an organic light emitting diode (OLED) device in a display panel for efficiency decay, the system including: a processor connected to the display panel and configured to:

acquire an IV curve of the OLED device according to a drain voltage with a preset number of grayscales applied to a driven thin-film transistor (TFT) and an output current corresponding to the drain voltage;

compare the IV curve with an IV curve database model, and determine a target curve and a first match curve of the OLED device, wherein the IV curve database model includes a plurality of curves of current versus voltage measured at different moments;

determine a second match curve corresponding to a measuring moment in an LV curve database model, according to a measuring moment corresponding to the first match curve, wherein the LV curve database model includes a plurality of curves of luminance versus voltage measured at different moments;

acquire, based on the second match curve, a target voltage corresponding to a target luminance; acquire, based on the target curve, a target current corresponding to the target voltage; and acquire, based on a characteristic curve of the driven TFT, a compensated gate voltage of the driven TFT through the target voltage, the target current, and the drain voltage.

The beneficial effect of the present disclosure is that in the above method embodiment of compensating an OLED device in a display panel for efficiency decay, the method including: acquiring an IV curve of the OLED device according to a drain voltage with a preset number of grayscales applied to a driven thin-film transistor (TFT) and an output current corresponding to the drain voltage; comparing the IV curve with an IV curve database model, and determining a target curve and a first match curve of the OLED device, wherein the IV curve database model includes a plurality of curves of current versus voltage measured at different moments; determining a second match curve corresponding to a measuring moment in an LV curve database model, according to a measuring moment corresponding to the first match curve, wherein the LV curve database model includes a plurality of curves of luminance versus voltage measured at different moments; acquiring, based on the second match curve, a target voltage corresponding to a target luminance; acquiring, based on the target curve, a target current corresponding to the target voltage; acquiring, based on a characteristic curve of the driven TFT, a compensated gate voltage of the driven TFT through the target voltage, the target current, and the drain voltage; and further compensating the OLED device for illuminating efficiency decay according to the compensated gate voltage. In the present disclosure, the OLED device is compensated for illumination efficiency decay by: acquiring the IV curve of the OLED device under different grayscales; comparing the detected IV curve with a preset IV curve database model to determine a decay condition of the OLED device; computing the target voltage of the OLED device under a required target luminance; acquiring the target current to realize the required target luminance after decay according to the IV curve of the OLED device; and lastly, acquiring the compensated gate voltage according to the target voltage, the target current, and the drain voltage in conjunction with the characteristic curve of the driven TFT. Thus, display effects of the display panel are improved, causing the display panel to display uniformly.

BRIEF DESCRIPTION OF DRAWINGS

The present disclosure is further described in conjunction with the accompanying drawings and embodiments below.

DETAILED DESCRIPTION OF EMBODIMENTS

In order that the technical features, objects, and effects of the present disclosure are more apparent to understand, specific embodiments of the present disclosure are described in conjunction with the accompanying drawings in detail below.

Figure 1:
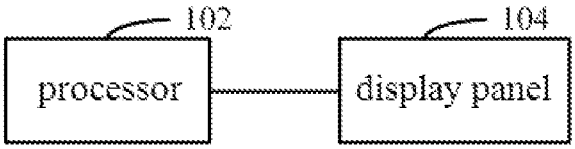
FIG. 1 is an application surrounding diagram of a method of compensating an organic light emitting diode (OLED) in a display panel for efficiency decay according to an embodiment.

The present disclosure provides a method of compensating an organic light emitting diode (OLED) in a display panel for efficiency decay, which can be applied in an application surrounding as shown in FIG. 1, wherein a processor 102 is connected to a display panel 104. The processor 102 can be, but not limited to, a microcontroller or an advanced reduced instruction set computer (RISC) machine (ARM) or a RISC microprocessor. The display panel 104 can be realized by an independent display panel or a display equipment consisting of a plurality of display panels.

Figure 2:
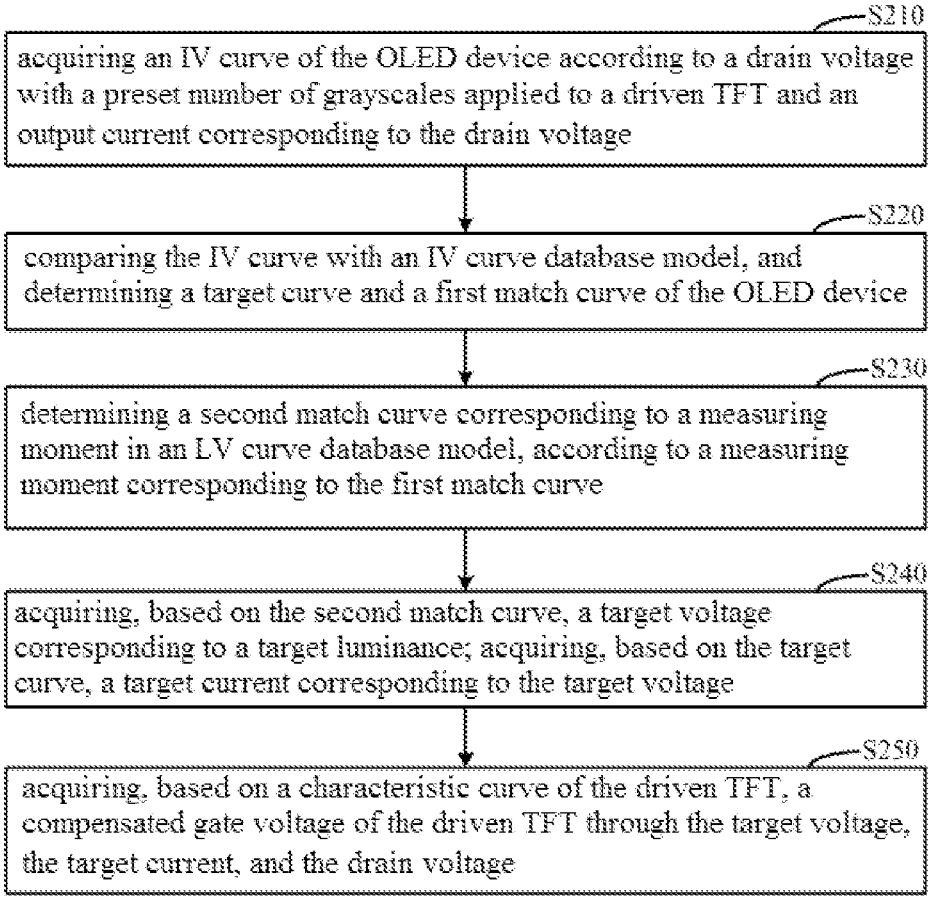
FIG. 2 is a first flowchart illustrating a method of compensating an OLED in a display panel for efficiency decay according to an embodiment.

In an embodiment, as shown in FIG. 2, a method of compensating an organic light emitting diode (OLED) device in a display panel for efficiency decay is provided. For example, the method applied in the processor 102 as shown in FIG. 1 includes the following steps:

Step S210: acquiring an IV curve of the OLED device according to a drain voltage with a preset number of grayscales applied to a driven thin-film transistor (TFT) and an output current corresponding to the drain voltage;

wherein the driven TFT means a TFT device configured for driving the OLED device to work; the TFT device means that each liquid crystal pixel point of a display device is driven by a TFT integrated behind; a grayscale means a level of shades of black-and-white images on which radiation strength of a ground electromagnetic wave shows, that is, a scale distinguishing features of ground spectrums; the grayscale means levels of brightness between the darkest and the brightest brightness, for example, brightness of bright pixels divided by 256 levels (i.e., 0-255 grayscales); the OLED device is a current-type organic light-emitting device, that is, illumination caused by injection and recovery of carriers, wherein illumination strength is proportional to an injected current; the IV curve refers to a curve of current versus voltage; in an embodiment, through establishing a two-dimension coordinate system whose the x-axis of voltage (i.e., V) and the y-axis of current (i.e., I), a corresponding IV curve can be further sketched in the two-dimension coordinate system according to each current data and each voltage data.

Specifically, when a gate electrode of the driven TFT is turned on, the drain voltage with a preset number of grayscales is sequentially applied to the driven TFT; the driven TFT can transfer an inputted drain voltage into an output current and further acquire a corresponding output current according to a preset number of drain voltages of the driven TFT; and thus, the IV curve of the OLED device can be sketched according to each drain voltage and each output current corresponding to each drain voltage.

Further, sequentially applying, based on a preset step length, the drain voltage with a grayscale from 0 to 255 to the driven TFT, capturing the output current of the driven TFT corresponding to the drain voltage, and thus acquiring the IV curve of the OLED device according to the drain voltage with a grayscale from 0 to 255 and the output current corresponding to the drain voltage with a grayscale from 0 to 255.

Step S220: comparing the IV curve with an IV curve database model, and determining a target curve and a first match curve of the OLED device, wherein the IV curve database model includes a plurality of curves of current versus voltage measured at different moments;

wherein the IV curve database model refers to curves (i.e., IV curves) of current versus voltage measured at different moments in the OLED device at an early stage of production of display panel. The IV curve database model can include a plurality of IV curves measured at different moments. The first match curve refers to an IV curve in the IV curve database model matching the acquired IV curve. The target curve refers to an IV curve corresponding to a target brightness. For example, the target curve can be an IV curve corresponding to brightness compensated to be in an initial state.

Specifically, the acquired IV curve of the OLED device is compared with the IV curve database model. According to the comparison result, the IV curve in the IV curve database model matching the acquired IV curve of the OLED device is determined as the first match curve, and the IV curve corresponding to brightness compensated to be in a target state is determined as the target curve.

For example, the IV curve database model includes an IV curve at moment t1, an IV curve at moment t2, and an IV curve at moment t3. Assuming that the IV curve at moment t1 is the IV curve corresponding to a target brightness, the target curve is the IV curve at moment t1. If the IV curve in the IV curve database model matching the acquired IV curve of the OLED device is the IV curve at moment t2, the first match curve is the IV curve at moment t2.

Step S230: determining a second match curve corresponding to a measuring moment in an LV curve database model, according to a measuring moment corresponding to the first match curve, wherein the LV curve database model comprises a plurality of curves of luminance versus voltage measured at different moments;

wherein the LV curve database model refers to curves (i.e., LV curves) of brightness versus voltage measured at different moments in the OLED device at an early stage of production of display panel. The LV curve database model can include a plurality of LV curves measured at different moments. The second match curve refers to an LV curve in the LV curve database model corresponding to the measuring moments of the first match curve.

Specifically, an LV curve having a measuring moment is acquired by inquiring the LV curve database model according to a corresponding measuring moment of the first match curve, and an LV curve in the LV curve database model corresponding to the measuring moment is determined as the second match curve according to the inquiry result.

For example, the IV curve database model includes an IV curve at moment t1, an IV curve at moment t2, and an IV curve at moment t3. The LV curve database model includes an LV curve at moment t1, an LV curve at moment t2, and an LV curve at moment t3. Assuming that a measuring moment of the first match curve is t1, an LV curve in the LV curve database model corresponding to the measuring moment t1 is determined as the second match curve according to the measuring moment t1 of the first match curve.

Step S240: acquiring, based on the second match curve, a target voltage corresponding to a target luminance; acquiring, based on the target curve, a target current corresponding to the target voltage;

wherein the target luminance refers to a required luminance to compensate for a preset luminance. For example, the target luminance can be an initial luminance of 255 grayscale. The target voltage refers to a required voltage to compensate for the target luminance. The target current refers to a current corresponding to the target voltage.

Specifically, a voltage corresponding to the target luminance can be acquired by inquiring the second match curve, and the voltage is determined as the target voltage. Further, the target voltage corresponding to the target luminance can be acquired. A current corresponding to the target voltage can be acquired by inquiring the target curve, and the current is determined as the target current. Further, the target current corresponding to the target voltage can be acquired.

Step S250: acquiring, based on a characteristic curve of the driven TFT, a compensated gate voltage of the driven TFT through the target voltage, the target current, and the drain voltage.

The characteristic curve of the driven TFT includes an output characteristic curve and a transfer characteristic curve. It needs to be stated that the output characteristic curve of the driven TFT reflects a TFT's saturation behavior, and the transfer characteristic curve reflects a TFT's switching characteristic. The compensated gate voltage refers to a required gate voltage applied to the driven TFT and corresponding to a luminance compensation. It needs to be stated that the gate voltage of the driven TFT is a data voltage coming from data lines.

Specifically, the compensated gate voltage of the driven TFT can be computed according to the target voltage, the target current, and the drain voltage in conjunction with the characteristic curve of the driven TFT. Further, the OLED device is compensated for illumination efficiency decay according to the compensated gate voltage.

In the above embodiment of a method of compensating an organic light emitting diode (OLED) device in a display panel for efficiency decay, the OLED device is compensated for illumination efficiency decay by: acquiring the IV curve of the OLED device under different grayscales; comparing the detected IV curve with a preset IV curve database model to determine a decay condition of the OLED device; computing the target voltage of the OLED device under a required target luminance; acquiring the target current to realize the required target luminance after decay according to the IV curve of the OLED device; and lastly, acquiring the compensated gate voltage according to the target voltage, the target current, and the drain voltage in conjunction with the characteristic curve of the driven TFT. Thus, display effects of the display panel are improved, causing the display panel to display uniformly.

Figure 3:
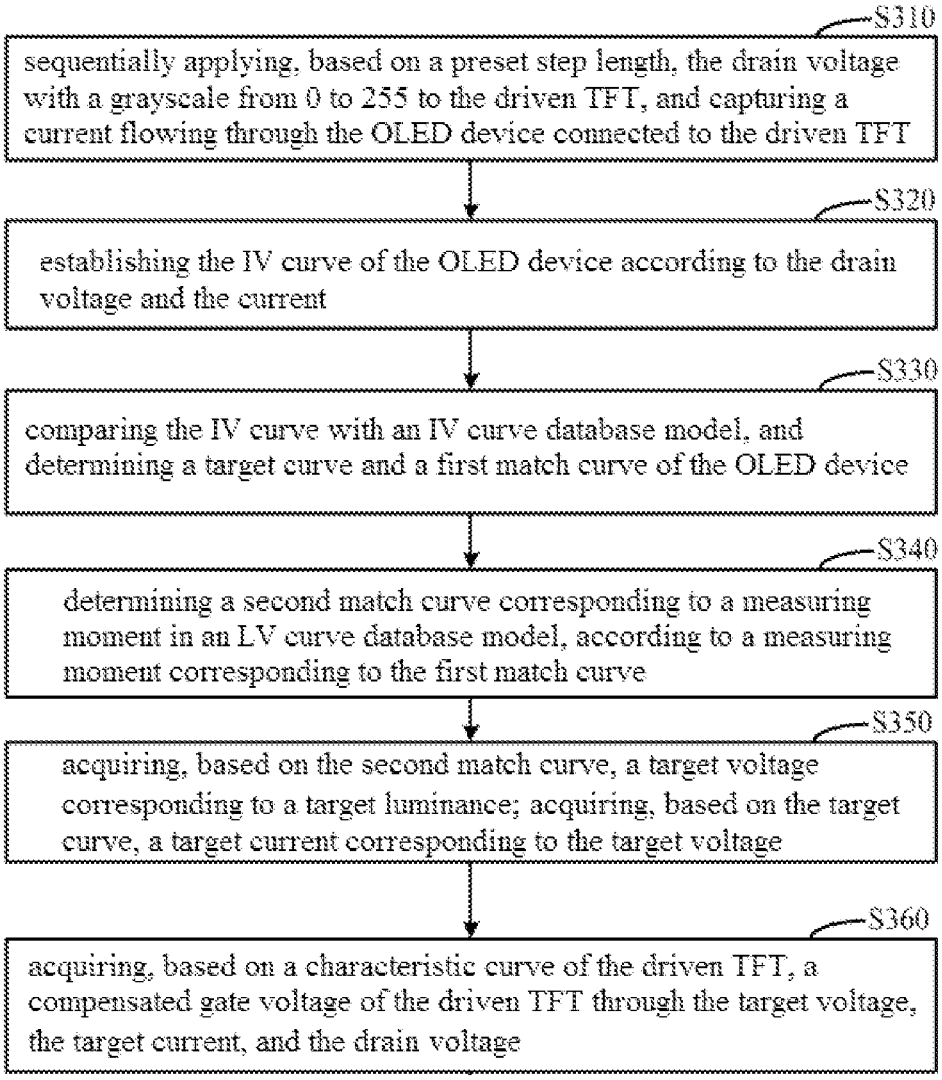
FIG. 3 is a second flowchart illustrating a method of compensating an OLED in a display panel for efficiency decay according to an embodiment.

In an embodiment, as shown in FIG. 3, a method of compensating an organic light emitting diode (OLED) device in a display panel for efficiency decay is provided. For example, the method applied in the processor 102 as shown in FIG. 1 includes the following steps:

Step S310: sequentially applying, based on a preset step length, the drain voltage with a grayscale from 0 to 255 to the driven TFT, and capturing a current flowing through the OLED device connected to the driven TFT;

wherein the preset step length is based on a unit of grayscale level. For example, the preset step length can be set as one or two grayscales.

In an embodiment, the preset step length includes at least one grayscale.

Specifically, changing the inputted drain voltages according to the preset step length (i.e., voltages corresponding to 0-255 grayscales) on the basis that potential of the gate electrode of the driven TFT is adjusted as a high potential (i.e., transmitting a high potential to the driven TFT through data lines), the driven TFT lies in a linear region, and the drain voltage of the driven TFT, meanwhile, is approximately equal to a source voltage; and capturing currents flowing through the OLED device connected to the driven TFT and corresponding to different drain voltages.

Step S320: establishing the IV curve of the OLED device according to the drain voltage and the current.

Specifically, the IV curve of the OLED device can be suggested to acquire by inputting different drain voltages and each captured current.

Step S330: comparing the IV curve with an IV curve database model, and determining a target curve and a first match curve of the OLED device, wherein the IV curve database model comprises a plurality of curves of current versus voltage measured at different moments;

Step S340: determining a second match curve corresponding to a measuring moment in an LV curve database model, according to a measuring moment corresponding to the first match curve, wherein the LV curve database model comprises a plurality of curves of luminance versus voltage measured at different moments;

Step S350: acquiring, based on the second match curve, a target voltage corresponding to a target luminance; acquiring, based on the target curve, a target current corresponding to the target voltage; and Step S360: acquiring, based on a characteristic curve of the driven TFT, a compensated gate voltage of the driven TFT through the target voltage, the target current, and the drain voltage.

The specific content and process of the steps S330, S340, S350, and S360 can be referred with reference to the above description and are not repeated here.

Specifically, the OLED device is compensated for illumination efficiency decay by: acquiring the IV curve of the OLED device under different grayscales; comparing the detected IV curve with a preset IV curve database model to determine a decay condition of the OLED device; computing the target voltage of the OLED device under a required target luminance; acquiring the target current to realize the required target luminance after decay according to the IV curve of the OLED device; and lastly, acquiring the compensated gate voltage according to the target voltage, the target current, and the drain voltage in conjunction with the characteristic curve of the driven TFT. Thus, display effects of the display panel are improved, causing the display panel to display uniformly.

Figure 4:
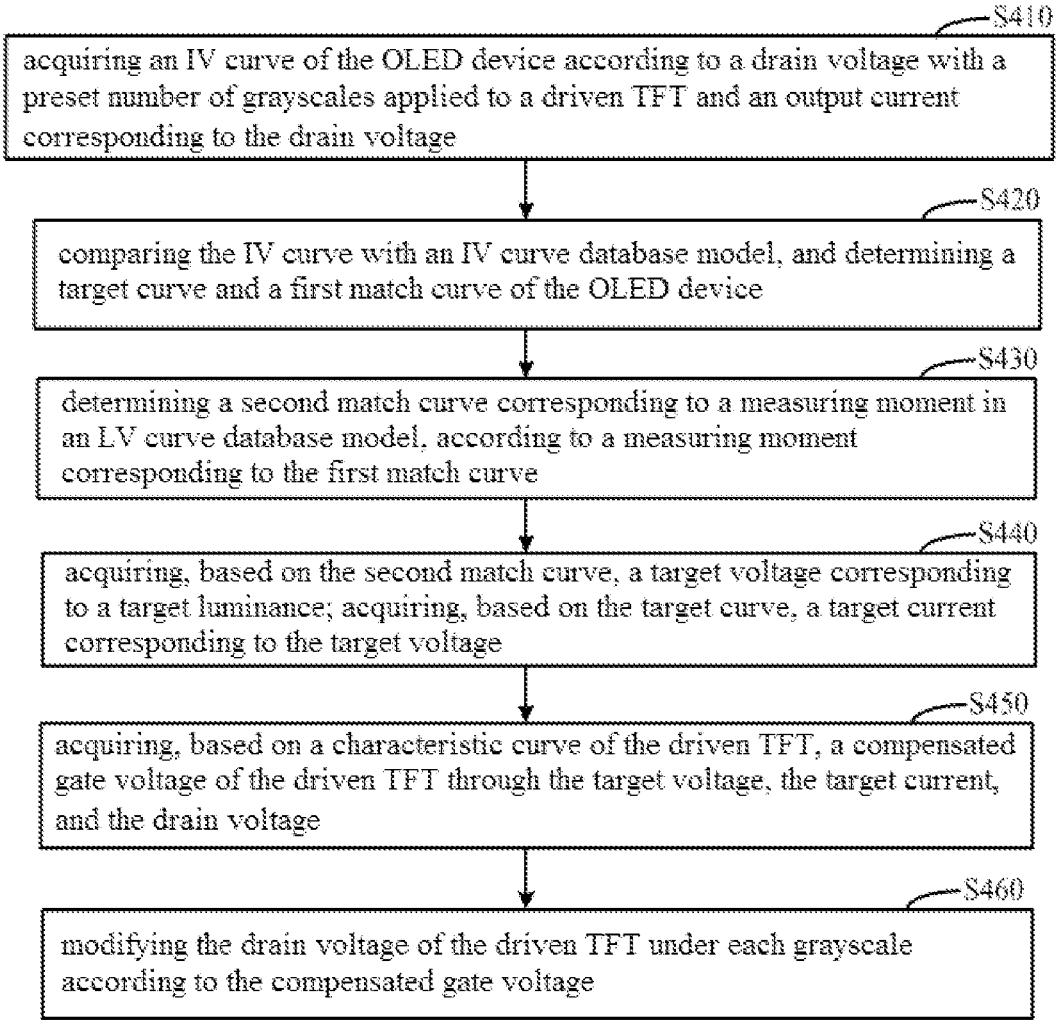
FIG. 4 is a third flowchart illustrating a method of compensating an OLED in a display panel for efficiency decay according to an embodiment.

In an embodiment, as shown in FIG. 4, a method of compensating an organic light emitting diode (OLED) device in a display panel for efficiency decay is provided. For example, the method applied in the processor 102 as shown in FIG. 1 includes the following steps:

Step S410: acquiring an IV curve of the OLED device according to a drain voltage with a preset number of grayscales applied to a driven thin-film transistor (TFT) and an output current corresponding to the drain voltage;

Step S420: comparing the IV curve with an IV curve database model, and determining a target curve and a first match curve of the OLED device, wherein the IV curve database model comprises a plurality of curves of current versus voltage measured at different moments;

Step S430: determining a second match curve corresponding to a measuring moment in an LV curve database model, according to a measuring moment corresponding to the first match curve, wherein the LV curve database model comprises a plurality of curves of luminance versus voltage measured at different moments;

Step S440: acquiring, based on the second match curve, a target voltage corresponding to a target luminance; acquiring, based on the target curve, a target current corresponding to the target voltage;

Step S450: acquiring, based on a characteristic curve of the driven TFT, a compensated gate voltage of the driven TFT through the target voltage, the target current, and the drain voltage; and Step S460: modifying the drain voltage of the driven TFT under each grayscale according to the compensated gate voltage.

The specific content and process of the steps S410, S420, S430, S440, and S450 can be referred with reference to the above description and are not repeated here.

Specifically, the IV curve database model and the LV curve database model are established in advance, that is, I, V, and L change over time; and the IV curve of the OLED device is acquired by measuring a current of the OLED device corresponding to different grayscale voltages. Then, a stress condition of the OLED device is determined by comparing the acquired IV curve with the IV curve database model, a target voltage of the OLED device under a required target brightness is computed, and a required target current to fulfill the required brightness after a stress according to the IV curve of the OLED device is acquired. Lastly, a compensated gate voltage is acquired according to the target voltage, the drain voltage, and the target current in conjunction with the characteristic curve of the driven TFT, and the gate voltages (i.e., voltages of the signal Data) under different grayscales are modified according to the result of deducing. Thus, the OLED device is compensated for illumination efficiency decay, and display effects of the display panel are improved, causing the display panel to display uniformly.

It should be understood that although each step in the flowcharts of FIG. 2 and FIG. 4 may be displayed in succession as indicated by an arrow, these steps are not necessarily executed in succession in the order indicated by the arrows. Unless expressly described herein, the execution of these steps may not be limited to a strict order; instead, the steps can be executed in another order. In addition, at least some steps in FIG. 2 and FIG. 4 may include multiple sub-steps or multiple stages. These sub-steps or stages may not necessarily be executed or completed at the same moment, but can be executed at different times, and the order of execution thereof may also not necessarily be in succession, but can be executed in turn or alternately with at least some other steps or sub-steps or stages of other steps.

Figure 5:
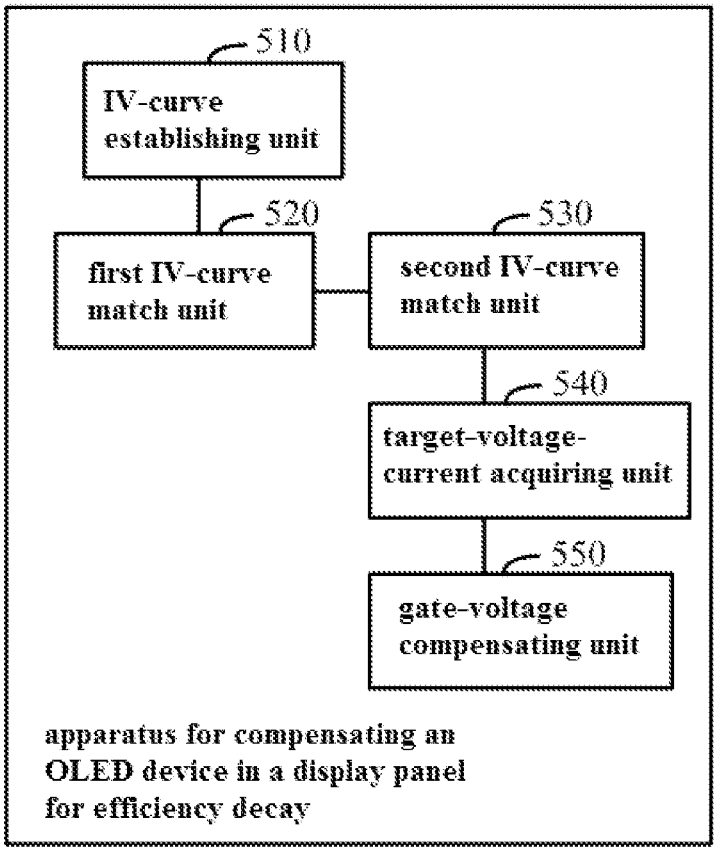
FIG. 5 is a schematic block diagram of an apparatus configured to compensate an OLED in a display panel for efficiency decay according to an embodiment.

In an embodiment, as shown in FIG. 5, an apparatus configured to compensate an organic light emitting diode (OLED) device in a display panel for efficiency decay is further provided. The apparatus includes:

an IV-curve establishing unit 510 configured to acquire an IV curve of the OLED device according to a drain voltage with a preset number of grayscales applied to a driven thin-film transistor (TFT) and an output current corresponding to the drain voltage;

a first IV-curve match unit 520 configured to compare the IV curve with an IV curve database model and to determine a target curve and a first match curve of the OLED device, wherein the IV curve database model comprises a plurality of curves of current versus voltage measured at different moments;

a second IV-curve match unit 530 configured to determine a second match curve corresponding to a measuring moment in an LV curve database model, according to a measuring moment corresponding to the first match curve, wherein the LV curve database model comprises a plurality of curves of luminance versus voltage measured at different moments;

a target-voltage-current acquiring unit 540 configured to acquire, based on the second match curve, a target voltage corresponding to a target luminance and to acquire, based on the target curve, a target current corresponding to the target voltage; and a gate-voltage compensating unit 550 configured to acquire, based on a characteristic curve of the driven TFT, a compensated gate voltage of the driven TFT through the target voltage, the target current, and the drain voltage.

As to specific limitation to an apparatus configured to compensate an OLED device in a display panel for efficiency decay, it can be referred to the above description and is not repeated here. Each of the above modules in the apparatus configured to compensate an OLED device in a display panel for efficiency decay can be realized totally or partially through software, hardware, and their combination. Each of the above modules can use a hardware form to be embedded in or independent to a processor in a system configured to compensate an OLED device in a display panel for efficiency decay, and can also use a software form to be stored in a memory in a system configured to compensate an OLED device in a display panel for efficiency decay in order that the processor invokes and executes operation corresponding to each of the above modules.

Figure 6:
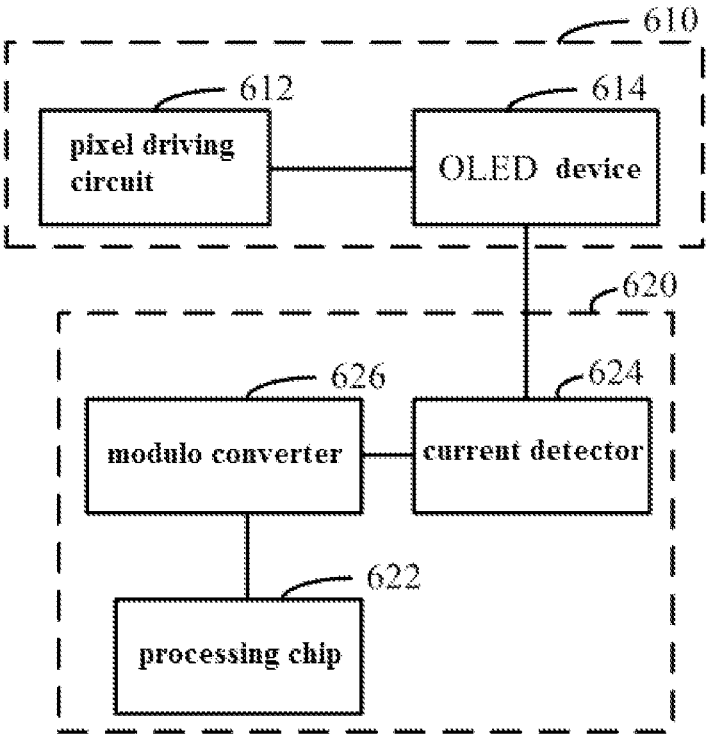
FIG. 6 is a schematic structural diagram of a system configured to compensate an OLED in a display panel for efficiency decay according to an embodiment.

In an embodiment, as shown in FIG. 6, a system configured to compensate an organic light emitting diode (OLED) device in a display panel for efficiency decay is further provided. The system includes a processor 620 connected to the display panel 610.

The processor 620 is configured to execute any step in the method of compensating the organic light emitting diode (OLED) device in the display panel for efficiency decay.

The processor 620 can be, but not limited to, a microcontroller or an advanced RISC machine (ARM), and so on.

Specifically, the processor 620 can be configured to:

acquire an IV curve of the OLED device according to a drain voltage with a preset number of grayscales applied to a driven thin-film transistor (TFT) and an output current corresponding to the drain voltage;

compare the IV curve with an IV curve database model, and determine a target curve and a first match curve of the OLED device, wherein the IV curve database model comprises a plurality of curves of current versus voltage measured at different moments;

determine a second match curve corresponding to a measuring moment in an LV curve database model, according to a measuring moment corresponding to the first match curve, wherein the LV curve database model comprises a plurality of curves of luminance versus voltage measured at different moments;

acquire, based on the second match curve, a target voltage corresponding to a target luminance; acquire, based on the target curve, a target current corresponding to the target voltage; and acquire, based on a characteristic curve of the driven TFT, a compensated gate voltage of the driven TFT through the target voltage, the target current, and the drain voltage.

Specifically, the processor 620 compensates the OLED device for illumination efficiency decay by: acquiring the IV curve of the OLED device under different grayscales; comparing the detected IV curve with a preset IV curve database model to determine a decay condition of the OLED device; computing the target voltage of the OLED device under a required target luminance; acquiring the target current to realize the required target luminance after decay according to the IV curve of the OLED device; and lastly, acquiring the compensated gate voltage according to the target voltage, the target current, and the drain voltage in conjunction with the characteristic curve of the driven TFT. Thus, display effects of the display panel are improved, causing the display panel to display uniformly.

In a specific embodiment, as shown in FIG. 6, the display panel 610 includes a pixel driving circuit 612 and an OLED device 614 connected to the pixel driving circuit 612. The processor 620 is connected to the OLED device 614.

The pixel driving circuit 612 refers to a circuit for driving the OLED device to work. The pixel driving circuit 612 can be a voltage-controlled pixel driving circuit and can also be a current-controlled pixel driving circuit.

It needs to be stated that the display panel 610 includes at least a pair of pixel driving circuits and an OLED device connected to the pixel driving circuit.

Further, the pixel driving circuit is a 2T1C pixel driving circuit or a 3T1C pixel driving circuit.

The 2T1C pixel driving circuit refers to an OLED pixel driving circuit of 2T1C structure (i.e., two TFTs and one capacitor). The 3T1C pixel driving circuit refers to an OLED pixel driving circuit of 3T1C structure (i.e., three TFTs and one capacitor).

In a specific embodiment, as shown in FIG. 6, the processor 620 includes a processing chip 622, a current detector 624 connected to the OLED device 614, and a modulo converter 626 connecting the processing chip 622 and the current detector 624.

The processing chip 622 can a microcontroller (e.g. 51-series processing chip). The current detector 624 refers to a current sensor. For example, the current detector can be an electromagnetic current transformer or an electronic current transformer. The modulo converter 626 is an A/D converter (ADC) which usually refers to an electronic component for transferring a simulating signal into a digital signal. In general, the modulo converter transfers an input-voltage signal into an output-digit signal.

In a specific embodiment, the display panel can be an active-matrix organic light-emitting diode (AMOLED) display panel or a micro light-emitting diode (MicroLED) display panel.

Figure 7:
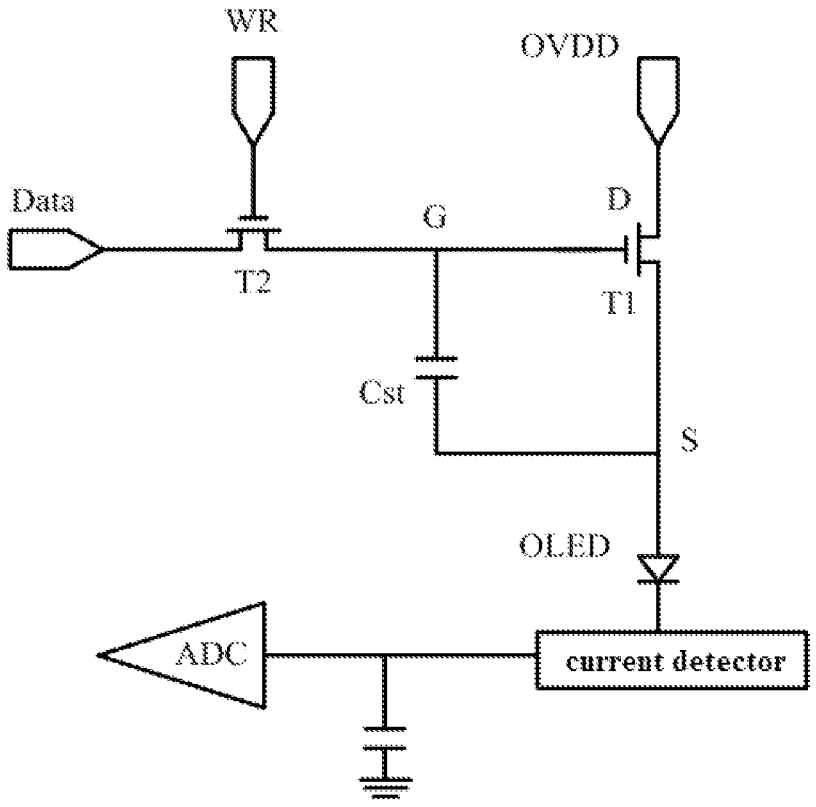
FIG. 7 is a schematic circuit diagram of a 2T1C pixel driving circuit according to an embodiment.

In a specific embodiment, as shown in FIG. 7, taking a 2T1C pixel driving circuit as an example, a system configured to compensate an OLED device in a display panel for efficiency decay is provided.

Figure 8:
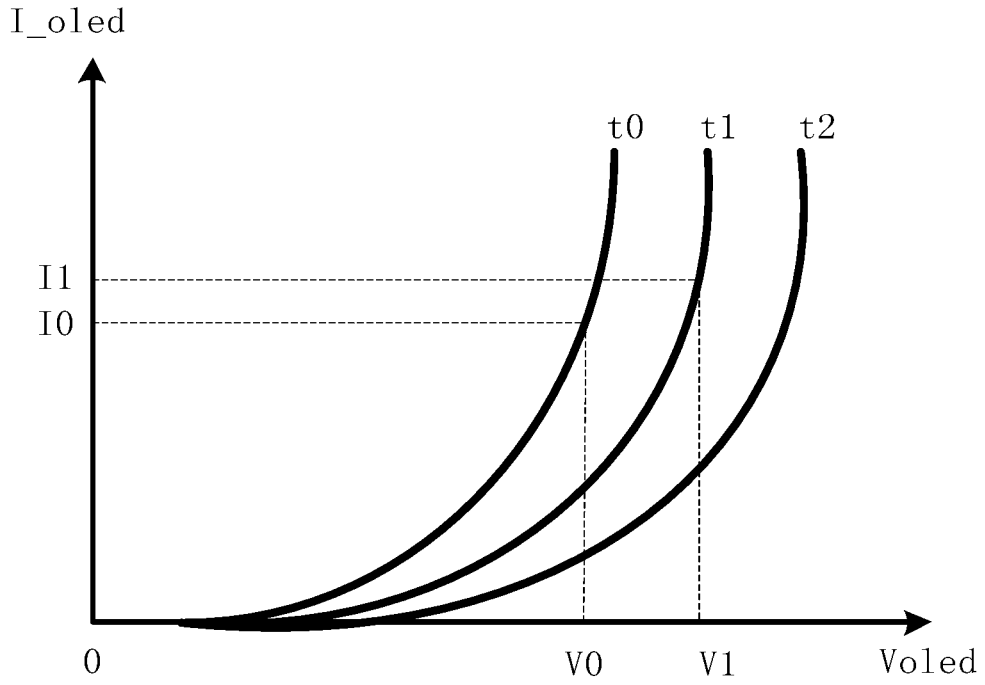
FIG. 8 is a schematic curve diagram of an IV curve database model according to an embodiment.
Figure 9:
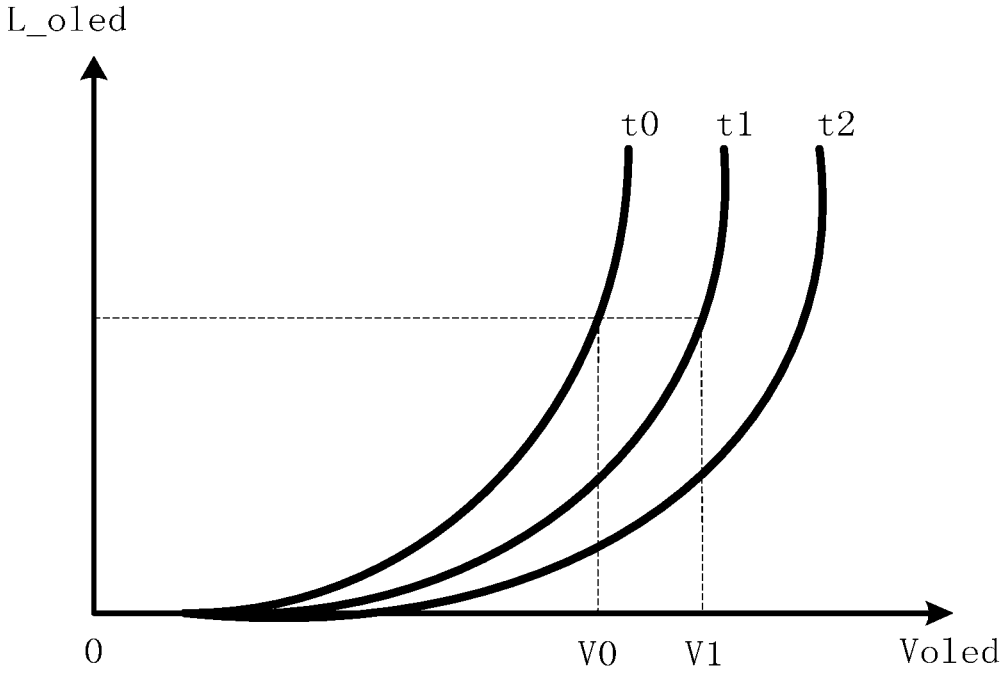
FIG. 9 is a schematic curve diagram of an LV curve database model according to an embodiment.
Figure 10:
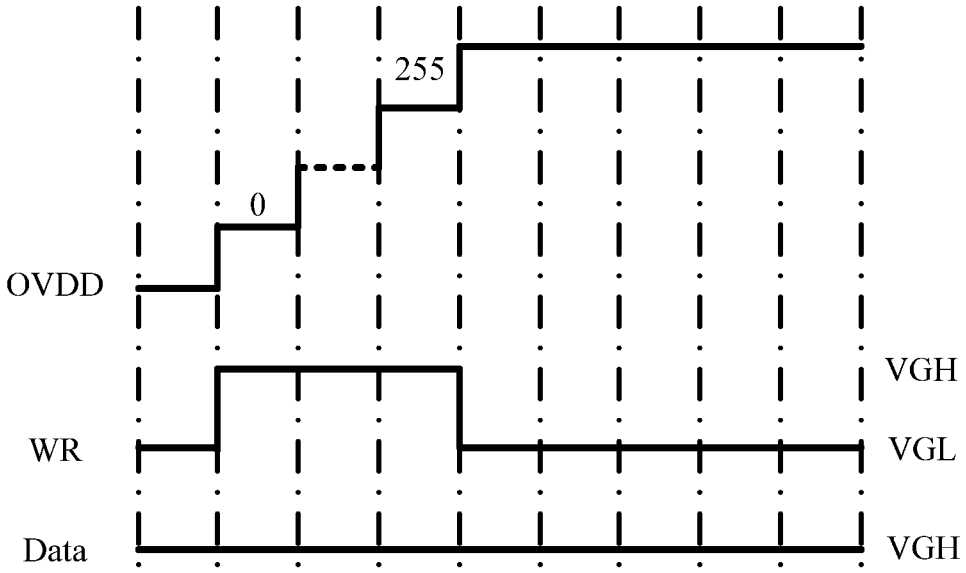
FIG. 10 is a first detecting timing diagram of an OLED device according to an embodiment.

Establishing the IV curve database model as shown in FIG. 8 and the LV curve database model as shown in FIG. 9 in advance; and measuring the IV curve of the OLED device under different voltages of a signal OVDD (i.e., 0-255 grayscales) according to the detecting timing diagram as shown in FIG. 10. Specific operations are as follows: first, changing the voltages of the signal OVDD according to a certain step length (i.e., 0-255 grayscales) on the basis that a signal WR is adjusted as a high potential, an induction-type TFT T2 is turned on, a signal Data is changed to a direct-current high potential VGH, a driven TFT T1 lies in a linear region, and a drain voltage Vd, meanwhile, is approximately equal to a source voltage Vs; detecting a current under different voltages of the signal OVDD through the current detector; acquiring the IV curve of the OLED device further; comparing the IV curve with the database model as shown in FIG. 8 again to determine a stress condition (i.e., t0-t1) of the OLED device, computing a practical voltage V1, equal to a voltage of a point S in FIG. 7, of the OLED device under a required brightness according to a corresponding LV curve in FIG. 9, and then acquiring a required target current to fulfill the required brightness after a stress according to the IV curve of the OLED device; and lastly, deducing and processing a required gate voltage (i.e., the voltage of the signal Data) under the condition of determining the source voltage of T1, the drain voltage (i.e., the voltage of the signal OVDD), and a required target current in conjunction with the characteristic curve of the TFT, and modifying the voltages of the signal Data of different grayscales according to the result of deducing. Thus, the OLED device is compensated for illumination efficiency decay, and display effects of the display panel are improved.

As shown in FIG. 10, it needs to be stated that the voltage of the signal Data in a detecting phase is a high potential VGH, and the voltages of the signal OVDD continuously change from 0 to 255 grayscales in order to detect the IV curve of the OLED device in the course of using the display panel. VGH is a high potential, and VGL is a low potential.

In an embodiment in conjunction with FIG. 7, accuracy of detecting the IV curve of the OLED device is simulated. From the following table, it can be seen that a detected IV curve basically overlaps the IV curve of the OLED device itself between 1V and 5V. The result in the table shows that accuracy of current detection decreases with an increased signal OVDD, but the accuracy is greater than 97% while the voltage of the signal OVDD is below 5V (i.e., 255 grayscale voltage). Thus, the IV curve of the OLED device can be detected accurately. Then, the detected curve is compared with a preset IV curve database model and a preset LV curve database model. Assuming that the detected curve overlaps a curve corresponding to moment t1, a stress condition of the OLED device can be determined according to curves at moments t0-t1, and a required increment of voltage (i.e., V1-V0) to compensate for brightness in an initial state (or a target state) can be known. Lastly, a required voltage of the signal Data to compensate for brightness of the OLED device can be acquired by combining the Id-Vd characteristic curve of the TFT with the Ig-Vd characteristic curve of the TFT, and then each grayscale voltage is renewed based on the required voltage. Thus, the OLED device is compensated for illumination efficiency decay.

| OVDD (V) | S (V) | I (nA) | Ioled (nA) | Accuracy of current |
|---|---|---|---|---|
| 5 | 4.95 | 319 | 336 | 97.4% |
| 4 | 3.98 | 108 | 111 | 98.63% |
| 3 | 2.997 | 16.6 | 16.8 | 99.4% |
| 2 | 2 | 0.989 | 0.989 | 100% |
| 1 | 1 | 0.48 | 0.48 | 100% |

Figure 11:
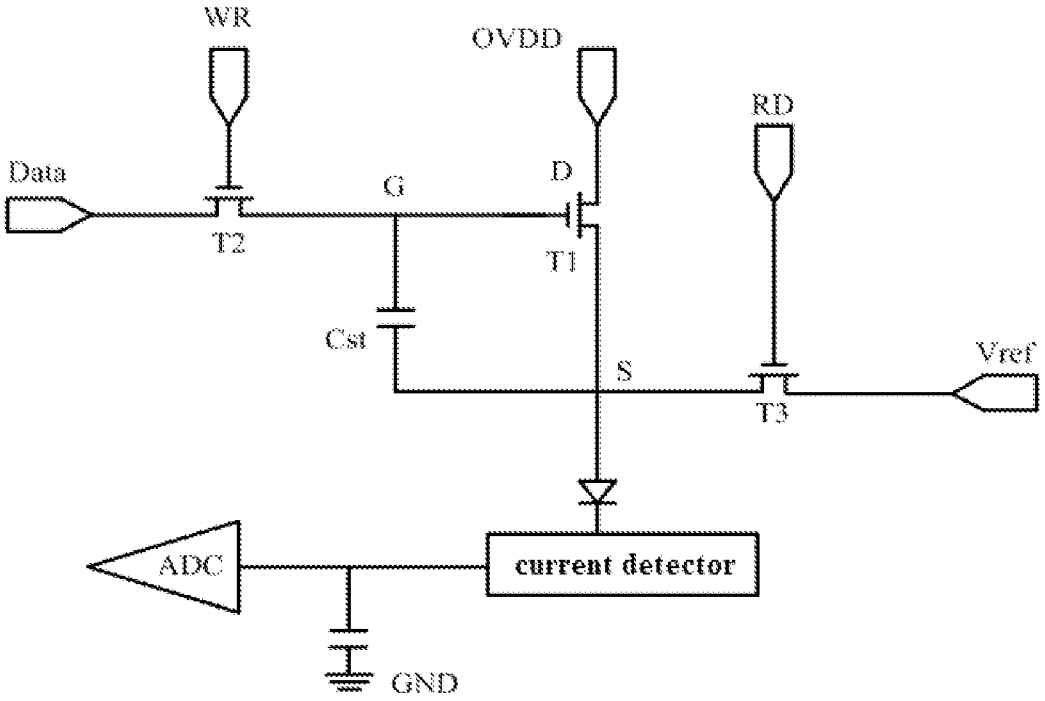
FIG. 11 is a schematic circuit diagram of a 3T1C pixel driving circuit according to an embodiment.
Figure 12:
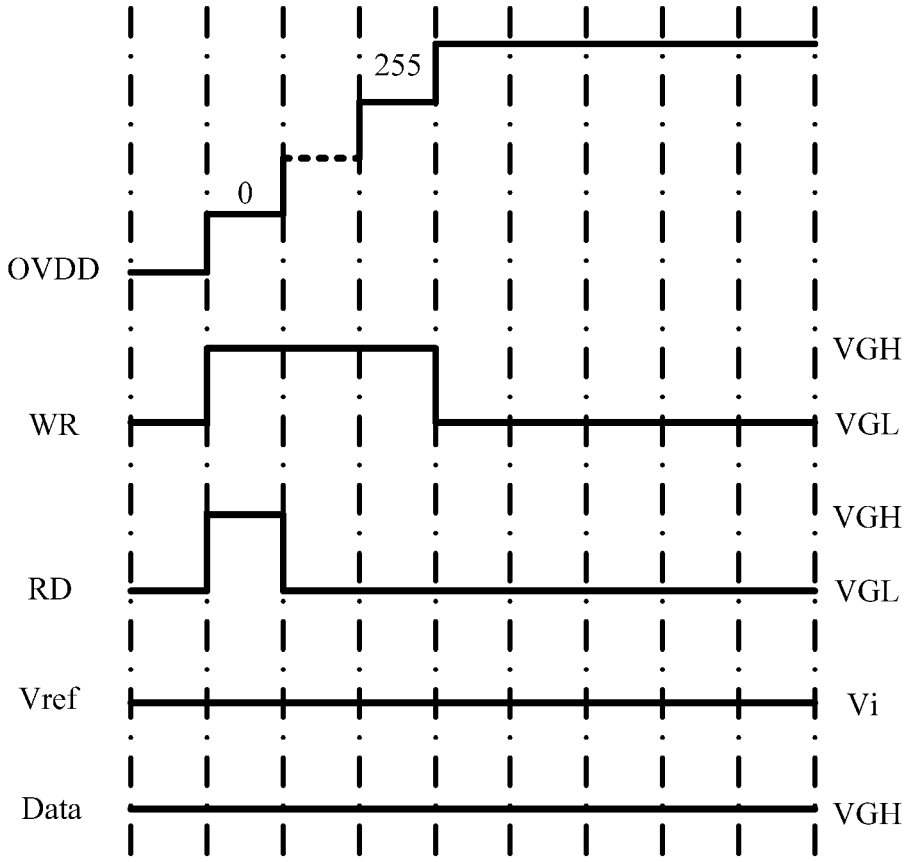
FIG. 12 is a second detecting timing diagram of an OLED device according to an embodiment.

In an embodiment, as shown in FIGS. 11-12, taking a 3T1C pixel driving circuit as an example, a system configured to compensate an OLED device in a display panel for efficiency decay is provided.

The circuit-detecting principle of the 3T1C pixel driving circuit is the same as that of the 2T1C pixel driving circuit. A difference between them is that a signal RD is turned on to initialize the point S when the circuit is detected, and an initial voltage Vi is equal to 0 (V). Then, the IV curve of the OLED device is detected according to the above method. A simulation result shows that a detection result under a 3T1C structure is the same as that under a 2T1C structure. Then, the method of using the detection result to respond to the signal Data is consistent with the above description.

As to specific limitation to compensation for the OLED device's efficiency decay under the 3T1C pixel driving circuit, it can be referred to the above description and is not repeated here.

Ordinary skilled in the art may understand, all or part of procedure in the above method embodiments may be implemented by the computer programs instructing hardware. The programs may be stored in a non-volatile computer readable storage medium. When the programs are executed, procedure as above methods of division may be included. Any reference to the memory, the storage, the database, or any other medium as used herein may include a non-volatile memory and/or a volatile memory. The suitable non-volatile memory may include a read-only memory (ROM), a programmable ROM (PROM), an electrically programmable (EPROM), an electrically erasable programmable ROM (EEPROM) and a flash memory. The volatile memory may include a random access memory (RAM) or an external high-speed cache memory. As illustration and without limitation, RAM may be implemented in many forms, such as static RAM (SRAM), dynamic RAM (DRAM), synchronic DRAM (SDRAM), double data rate SDRAM (DDR SDRAM), enhanced SDRAM (ESDRAM), synch-link DRAM (SLDRAM), memory bus (Rambus), direct RAM (RDRAM), direct memory bus dynamic RAM (DRDRAM), memory bus dynamic RAM (RDRAM), and so on.

Various technical features of embodiments described above may be combined arbitrarily. For simplicity of description, not all the possible combinations of various technical features in the above embodiments are described. Any combination of these technical features should fall in the scope of the present disclosure, as long as there is no contradiction.

Above embodiments merely illustrate some implementations of the present disclosure, which are described specifically and in detail, but do not constitute limitation to the scope of the present disclosure. It is to be noted that, those skilled in the art may make several modification and change without departing from the concept of the present disclosure, and these modification and change belong to the protection scope of the present disclosure. Thus, the protection scope of the present disclosure should be defined by appending claims.

What is claimed is:

1. A method of compensating an organic light emitting diode (OLED) device in a display panel for efficiency decay, the method comprising the following steps:

acquiring a current versus voltage (IV) curve of the OLED device according to drain voltages with a preset number of grayscales applied to a driven thin-film transistor (TFT) and output currents corresponding to the drain voltages;

comparing the IV curve with an IV curve database model, and determining a target curve and a first match curve of the OLED device, wherein the IV curve database model comprises a plurality of curves of current versus voltage measured at different moments;

determining, according to a measuring moment corresponding to the first match curve, a second match curve corresponding to the measuring moment in a luminance versus voltage (LV) curve database model, wherein the LV curve database model comprises a plurality of curves of luminance versus voltage measured at different moments;

acquiring, based on the second match curve, a target voltage corresponding to a target luminance;

acquiring, based on the target curve, a target current corresponding to the target voltage; and acquiring, based on a characteristic curve of the driven TFT, a compensated gate voltage of the driven TFT through the target voltage, the target current, and the drain voltages.

2. The method of claim 1, wherein the step of acquiring the IV curve of the OLED device according to the drain voltages with the preset number of grayscales applied to the driven TFT and the output currents corresponding to the drain voltages comprises:

sequentially applying, based on a preset step length, the drain voltages with grayscales from 0 to 255 to the driven TFT, and capturing currents flowing through the OLED device connected to the driven TFT; and establishing the IV curve of the OLED device according to the drain voltages and the currents.

3. The method of claim 2, wherein the preset step length comprises at least one grayscale.

4. The method of claim 1, further comprising, after the step of acquiring the compensated gate voltage of the driven TFT, a step of:

modifying a gate voltage of the driven TFT under each grayscale according to the compensated gate voltage.

5. A system configured to compensate an organic light emitting diode (OLED) device in a display panel for efficiency decay, the system comprising:

a processor connected to the display panel and configured to:

acquire a current versus voltage (IV) curve of the OLED device according to drain voltages with a preset number of grayscales applied to a driven thin-film transistor (TFT) and output currents corresponding to the drain voltages;

compare the IV curve with an IV curve database model, and determine a target curve and a first match curve of the OLED device, wherein the IV curve database model comprises a plurality of curves of current versus voltage measured at different moments;

determine, according to a measuring moment corresponding to the first match curve, a second match curve corresponding to the measuring moment in a luminance versus voltage (LV) curve database model, wherein the LV curve database model comprises a plurality of curves of luminance versus voltage measured at different moments;

acquire, based on the second match curve, a target voltage corresponding to a target luminance;

acquire, based on the target curve, a target current corresponding to the target voltage; and acquire, based on a characteristic curve of the driven TFT, a compensated gate voltage of the driven TFT through the target voltage, the target current, and the drain voltages.

6. The system of claim 5, wherein the processor is further configured to:

sequentially apply, based on a preset step length, the drain voltages with grayscales from 0 to 255 to the driven TFT, and capture currents flowing through the OLED device connected to the driven TFT; and establish the IV curve of the OLED device according to the drain voltages and the currents.

7. The system of claim 6, wherein the preset step length comprises at least one grayscale.

8. The system of claim 5, wherein the processor is further configured to modify a gate voltage of the driven TFT under each grayscale according to the compensated gate voltage.

9. The system of claim 5, wherein the display panel comprises a pixel driving circuit and the OLED device connected to the pixel driving circuit and the processor.

10. The system of claim 9, wherein the pixel driving circuit is a two-transistors-one-capacitor (2T1C) pixel driving circuit or a three-transistors-one-capacitor (3T1C) pixel driving circuit.

11. The system of claim 5, wherein the processor comprises a processing chip, a current detector connected to the OLED device, and a modulo converter connecting the processing chip and the current detector.

12. The system of claim 5, wherein the display panel is an active matrix organic light emitting diode (AMOLED) display panel or a micro light-emitting diode (LED) display panel.

* * * * *